United States Patent [19]

Iman

[11] 4,387,280

[45] Jun. 7, 1983

[54] HIGH SPEED HYDRAULICALLY-ACTUATED OPERATING SYSTEM FOR AN ELECTRIC CIRCUIT BREAKER

[75] Inventor: Imdad Iman, Colonie, N.Y.

[73] Assignee: General Electric Company, Schenectady, N.Y.

[21] Appl. No.: 323,849

[22] Filed: Nov. 23, 1981

Related U.S. Application Data

[63] Continuation of Ser. No. 154,232, May 29, 1978, abandoned.

[51] Int. Cl.[3] ..... H01H 35/38

[52] U.S. Cl. ..... 200/82 R; 200/34

[58] Field of Search ..... 200/34, 82 R, 82 B, 200/144 B, 148 R, 148 A, 148 G, 148 E, 148 J; 92/9, 10, 85 B

[56] References Cited

U.S. PATENT DOCUMENTS

| | | | |
|---|---|---|---|
| 2,740,859 | 12/1953 | Beatty | 200/82 B |
| 2,765,378 | 5/1953 | Perry | 200/82 B |
| 3,008,017 | 1/1958 | Strom | 200/82 B |
| 3,246,979 | 4/1966 | Lafferty | 200/144 B |
| 3,462,572 | 8/1969 | SoFianek | 200/148 G |
| 3,602,670 | 8/1971 | Teijeiro | 200/148 G |
| 3,677,141 | 7/1972 | Lagerqvist | 92/85 B |
| 3,739,125 | 6/1973 | Noeske | 200/148 A |
| 3,748,418 | 7/1973 | Kawasaki | 200/82 B |
| 3,908,106 | 9/1975 | Hirasawa | 200/82 B |
| 4,118,613 | 10/1978 | Barkan | 200/82 B |
| 4,166,937 | 9/1979 | Barkan | 200/82 B |

FOREIGN PATENT DOCUMENTS

| | | | |
|---|---|---|---|
| 52-50481 | 4/1977 | Japan | 92/85 B |
| 953 | of 1885 | United Kingdom | 92/10 |

*Primary Examiner*—G. P. Tolin

*Attorney, Agent, or Firm*—Charles E. Bruzga; James C. Davis, Jr.; Marvin Snyder

[57] ABSTRACT

This hydraulically-actuated operating system comprises a cylinder, a piston movable therein in an opening direction to open a circuit breaker, and an accumulator for supplying pressurized liquid to a breaker-opening piston-actuating space within the cylinder. A normally-closed valve between the accumulator and the actuating space is openable to allow pressurized liquid from the accumulator to flow through the valve into the actuating space to drive the piston in an opening direction. A dashpotting mechanism operating separately from the hydraulic actuating system is provided, thereby reducing flow restriction interference with breaker opening.

12 Claims, 3 Drawing Figures

HIGH SPEED HYDRAULICALLY-ACTUATED OPERATING SYSTEM FOR AN ELECTRIC CIRCUIT BREAKER

The Government of the United States of America has rights in this invention pursuant to Contract No. EX-76-C-01-2065 awarded by the U.S. Department of Energy.

This application is a continuation of application Ser. No. 154,232, filed May 29, 1978 now abandoned.

BACKGROUND OF THE INVENTION

This invention relates to an hydraulically-actuated operating system for operating an electric circuit breaker and, more particularly, relates to a system for reducing flow restriction impedance to high speed opening and closing of the circuit breaker.

The usual hydraulic operating system for producing high-speed operation and control of a circuit breaker typically comprises a main valve and a pilot valve for controlling the main valve. Typically, the pilot valve must be operated from a normal to an operated position to initiate operation of the main valve, which, in turn, initiates operation of the circuit breaker, and must then return to its normal position at the end of the circuit-breaker operation to restore the main valve to its initial position so as to prepare the system for operation of the circuit breaker in a reverse direction. This type of pilot valve operation requires rather involved controls, either electrical or hydraulic. Moreover, the need to first operate the pilot valve tends to increase the time required from the initial starting signal to operation of the main valve.

An approach to overcoming these limitations to actuator operation is disclosed in U.S. Pat. No. 4,118,613 issued Oct. 3, 1978 to Barkan et al. assigned to the instant assignee and incorporated herein by reference thereto. The above-cited patent discloses an hydraulically-actuated operating system for a circuit breaker which employs a fluid motor driven in the breaker opening direction by pressurized liquid and dashpotted by a plug restricting fluid flow through an opening surrounding the operating rod of the fluid motor.

SUMMARY OF THE INVENTION

An object of my invention is to effect high-speed circuit-breaker operation and control with an hydraulic operating system capable of very high-speed opening of a circuit breaker following an initial starting signal.

Another object of the instant invention is to provide an hydraulic operating system having minimum flow resistance to breaker opening movement. A more specific object of the instant invention is to provide external dashpotting for an hydraulically actuated fluid motor.

In one form of my instant invention, an hydraulically actuated operating system for a circuit breaker includes a fluid motor having a cylinder and a movable piston adapted to move through an opening stroke within the cylinder to open the circuit breaker and to move in a reverse direction within the cylinder during closing of the circuit breaker. An accumulator is provided for supplying pressurized liquid to an actuating space within the cylinder, and a normally closed valve located hydraulically between the accumulator and the actuating space can be opened to establish flow communication between the accumulator and the actuating space, so that pressurized liquid from the accumulator can flow through said valve to the actuating space to drive the piston through its opening stroke. A dashpot arrangement is provided which contacts the piston after it has moved to a gap sufficient for circuit interruption and brings the piston mechanism to rest without excessive impact. A vent located hydraulically downstream of the valve with respect to the accumulator is provided for affording communication between the actuating space and a low pressure region. Flow control means is provided for restricting leakage through said vent to a rate that prevents said leakage from substantially detracting from the development of pressure within said actuating space during the period from initial opening of said valve to the time when said piston has moved through most of its opening stroke. Following such period the vent provides for pressure decay in the actuating space and return means is provided for restoring the movable valve member to its closed position in response to said pressure decay.

BRIEF DESCRIPTION OF THE DRAWINGS

The features of the invention believed to be novel and unobvious over the prior art are set forth with particularity in the appended claims. The invention itself, however, as to organization, method of operation and advantages thereof, may best be understood by reference to the following description taken in conjunction with the accompanying drawings in which:

DETAILED DESCRIPTION OF PREFERRED EMBODIMENTS

Figure 1:
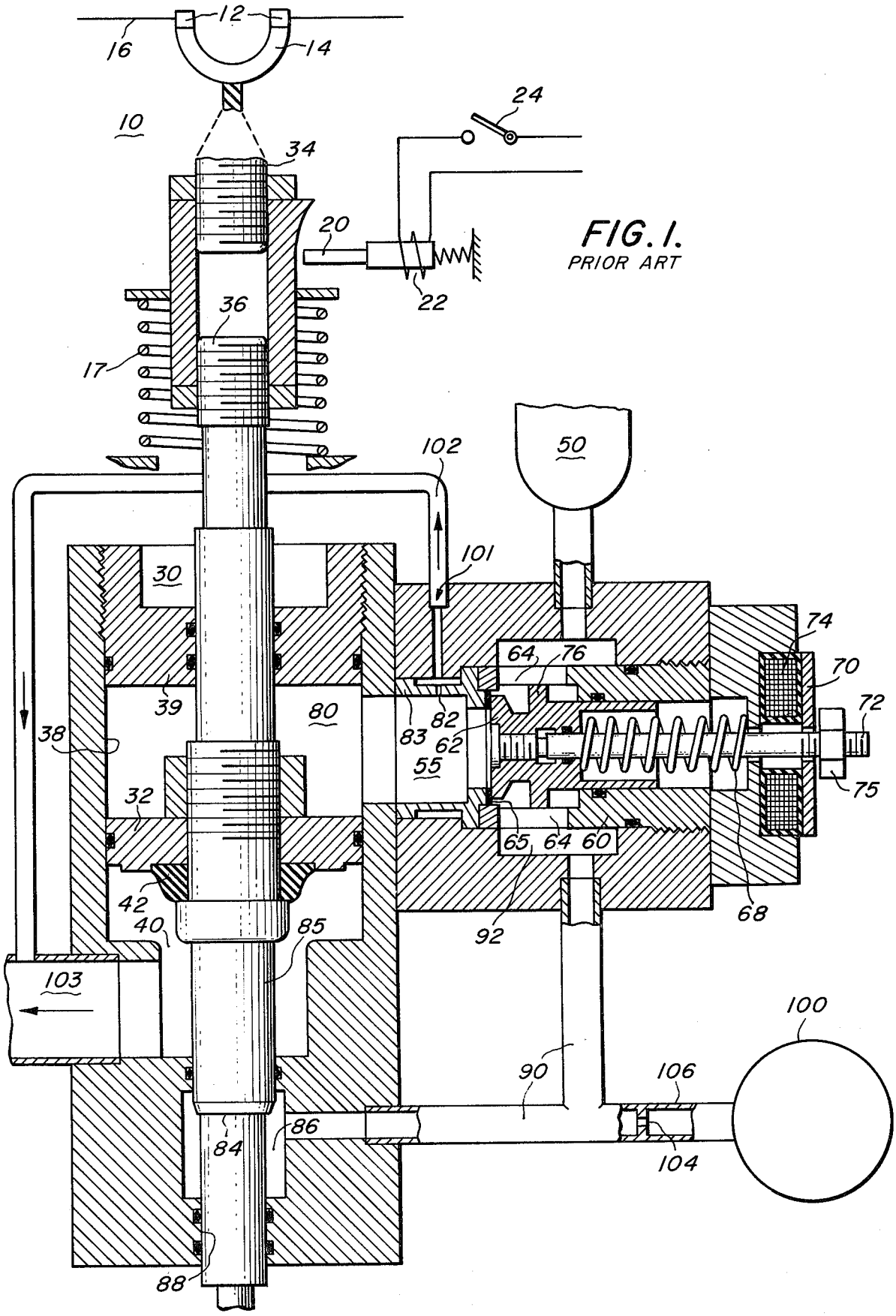
FIG. 1. PRIOR ART
FIG. 1 is a partially schematic sectional view of a circuit breaker including a prior art hydraulic operating system.

Referring now to FIG. 1, there is shown a circuit breaker 10 comprising a set of separable contacts 12 and 14 for controlling a power circuit 16 and including a prior art hydraulic actuator as described in the above-cited U.S. Pat. No. 4,118,613. The contacts 12 are stationary contacts, and the contact 14 is a movable contact that is biased by means of a suitable closing spring 17 and a small auxiliary fluid motor 84, 86 in a direction toward engagement with the stationary contacts. In FIG. 1, the circuit breaker 10 is shown with its contacts engaged and thus in closed position.

Opening of the circuit breaker is effected by driving movable contact 14 downwardly against the bias of closing spring 17 and auxiliary fluid motor 84, 86 to separate contact 14 from stationary contacts 12. When the movable contact 14 reaches its fully-open position, a suitable hold-open latch 20 acts to hold the circuit breaker open. Subsequent closing is effected by releasing the hold-open latch to permit the closing spring 17 and auxiliary motor 84, 86 to return the movable contact 14 upwardly to its closed position. This latch-release is effected by means of a solenoid 22 which is operated by completing an energizing circuit through its coil by closing a closing-control switch 24.

Power for driving the movable contact 14 into its open position during an opening operation is derived from a fluid motor 30 having a piston 32. Piston 32 is coupled to the movable contact 14 through an operating rod that has an insulating portion 34 and a metal portion 36 interconnecting the insulating portion 34 and the piston 32. The fluid motor 30 further comprises a cylinder 38 within which the piston 32 is vertically movable. The upper end of cylinder 38 is closed by an upper end wall 39 through which the piston rod portion 36 slidably extends in sealed relationship. The lower end wall of the cylinder 38 contains a central opening 40 through which a lower portion of the operating rod 34, 36 extends. A plug 42 on the operating rod is adapted to enter the opening 40 as the piston nears the end of its downward opening stroke, thereby restricting the flow of the liquid ahead of the downwardly-moving piston 32 through the opening 40 and thus providing a dashpotting effect that smoothly terminates downward opening motion of the piston.

Pressurized liquid for driving the piston 32 in a downward opening direction is derived from an accumulator 50. Accumulator 50 is of a conventional design but, for reasons soon to be explained, it has a limited capacity that allows it to supply pressurized liquid for only one complete circuit-breaker opening operation without requiring recharging.

Figure 3:
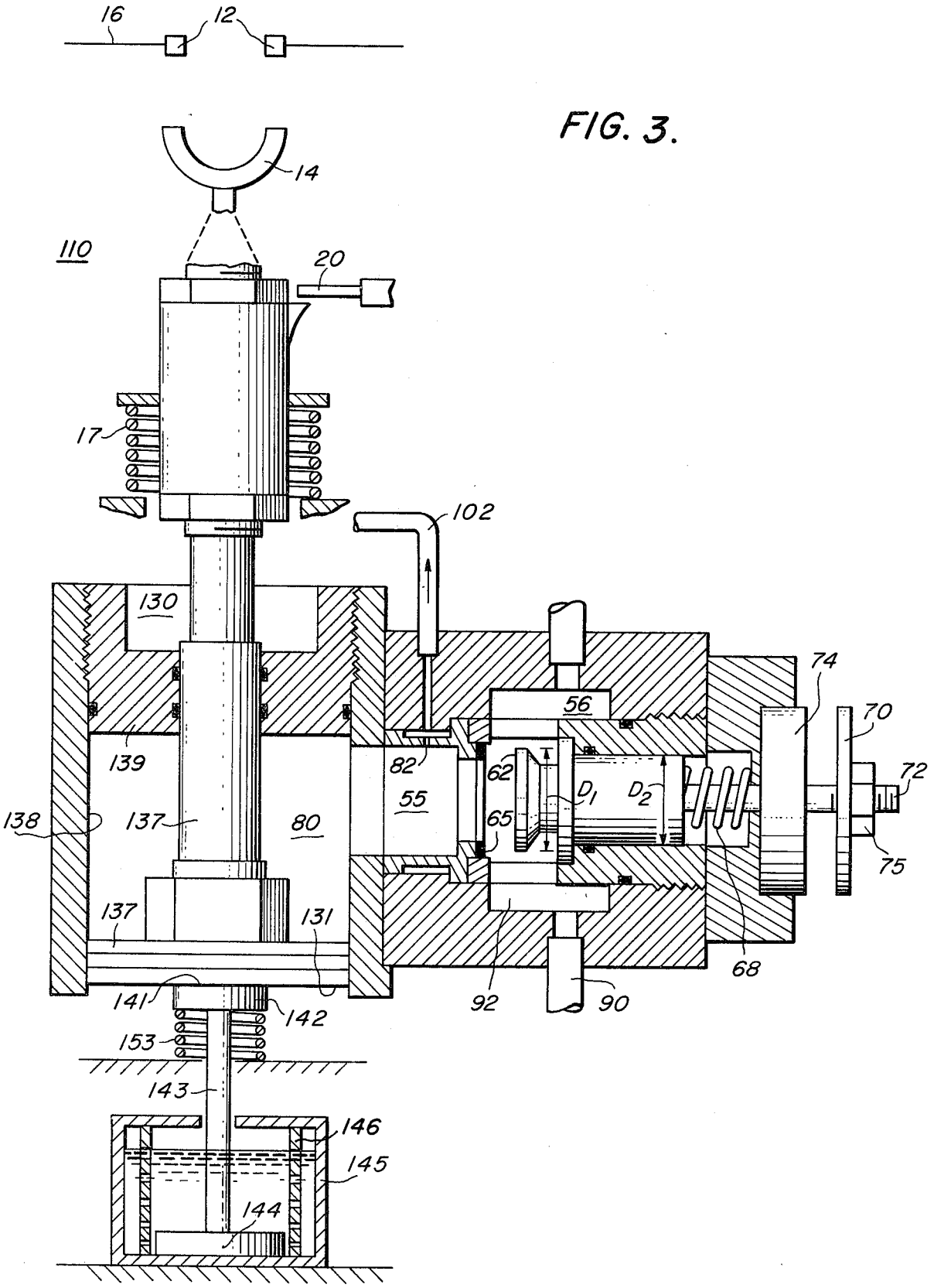
FIG. 3 is a partially schematic sectional view of the circuit breaker of FIG. 2 with the hydraulic operating system and dashpot arrangement shown at an instant near the end of the circuit breaker opening operation but prior to resetting of the control valve system.

Located hydraulically between the accumulator 50 and the piston 32 is a valve 56. The valve 56 comprises a cylindrical valve body 60 and a movable valve member 62 of the poppet type slidably mounted in the cylindrical valve body. The cylindrical valve body has large ports 64 extending therethrough and a valve seat 65 at its left-hand end against which the movable poppet valve member 62 seats when in its closed position. A compression spring 68 biases the movable valve member 62 into its closed position of FIG. 1, supplementing a slight hydraulic closing bias on the valve member 62 resulting from dimension $D_1$ of the movable main valve member 62 being slightly larger than $D_2$. These dimensions are best seen in FIG. 3.

For actuating the movable valve member 62, a repulsion-type solenoid of a generally conventional design comprising a stationary coil 74 and an armature 70 coupled to the movable valve member 62 through an operating rod 72 is employed. Armature 70 is a disc of highly conductive metal such as copper. The armature is normally held in close proximity to the stationary coil 74 by spring 68 and a nut 75 on rod 72. When the coil 74 is energized by a suitable pulse of current, it develops a magnetic field which induces eddy currents in the armature 70. These eddy currents generate a magnetic field which reacts with the magnetic field created by the coil to produce a rapidly rising repulsion force between the armature and the coil that quickly drives the armature toward the right against the above-described opposing bias. This movement of the armature 74 to the right acts through nut 75 and operating rod 72 to drive the movable valve member 62 to the right.

Movement of the valve member 62 from its position to the right allows high pressure liquid to immediately flow past the valve seat 65 and build up a high pressure in the actuating space 80 above piston 32. This high pressure liquid also acts on the left-hand face of the movable valve member 62, rapidly providing a high force on valve member 62 that forces it to the right at high speed. When the valve member 62 nears its open position at the end of its rightward opening stroke, a piston 76 thereon enters the closed end of the valve body, providing a dashpotting effect that smoothly terminates such opening movement of the valve member.

The orifice 82 in tubular body 83 serves to prevent an inadvertent pressure buildup in the actuating space 80 should there be any leakage past movable main valve member 62 when it is in its closed position. As the piston 32 (after having completed most of its opening stroke) decelerates in response to the above-described dashpotting effect of parts 42, 40, the pressure in actuating space 80 rises; and this increased pressure produces leakage at an increased rate through the venting orifice 82. Flow control means 101 is provided for controlling flow through the orifice 82. This flow control means 101 comprises a long tube 102 of restricted cross-sectional area that is connected hydraulically in series with the venting orifice 82 between the actuating space 80 and the low pressure sump 103.

Figure 2:
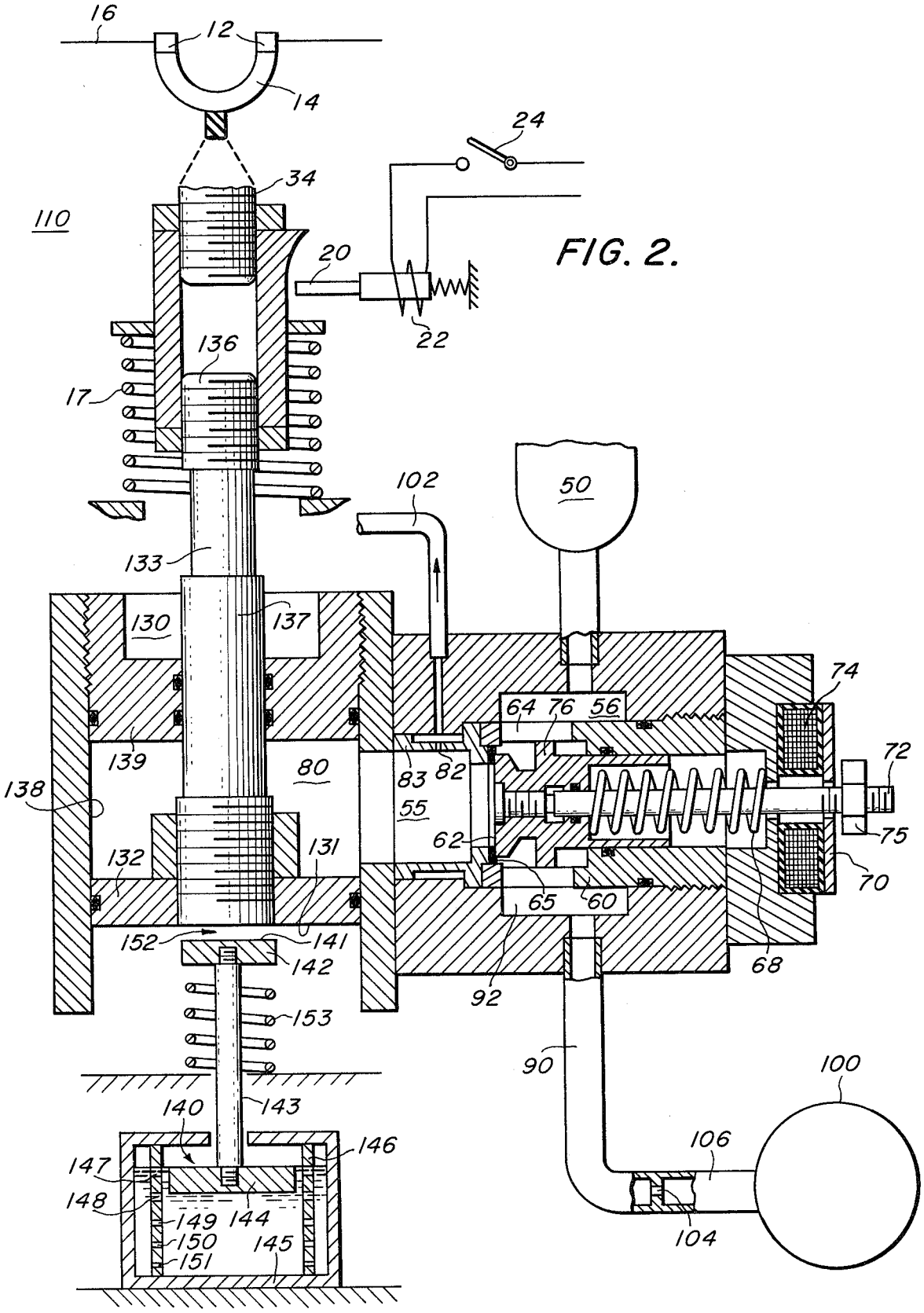
FIG. 2 is a partially schematic sectional view of a circuit breaker including an hydraulic operating system and dashpot arrangement embodying the instant invention, in which the hydraulic operating system and dashpot arrangement are shown in their normal at rest condition in which it is prepared to initiate an opening operation of the circuit breaker.

Referring now to FIGS. 2 and 3 there is shown a circuit breaker 110 comprising an hydraulic actuating system incorporating the dashpot arrangement of the instant invention. The mechanism for moving movable contact 14 into its open position during an opening operation comprises a fluid motor 130 having a piston 132 disposed within cylinder 138 which is closed at the upper end by an upper end wall 139 through which piston rod 133 slidably extends in sealed relationship. The piston rod 133 includes insulating portion 34 and metal portion 136 interconnecting the insulating portion 34 and the piston 132. The metal portion 136 includes an enlarged portion 137 extending through end wall 139 and fastened to piston 132. At the lower end of the fluid motor 130 is disposed a dashpot 140 including an abutment 142, a cylindrical shaft 143 and plunger 144. Plunger 144 is disposed within a dashpot enclosure 145 which encloses a cylindrical sleeve 146 having a plurality of radially extending holes 147, 148, 149, 150 and 151 passing generally radially therethrough. It will be noted that the holes in the sleeve 146 become progressively smaller moving toward the bottom of the sleeve. This allows for low hydraulic resistance to movement at first contact of the piston 132 with the abutment 142 and gradually increasing hydraulic resistance to further vertically downward motion until the plunger 144 abuts the bottom wall of the dashpot enclosure 145. In this way movement of piston 132 is gradually slowed and stopped without subjecting the piston to shock. A gap 152 is located between the lower surface 131 of the piston 132 and the upper surface 141 of the abutment 142 in order to provide no interference with the initial opening movement of piston 132 and the contact 14, so that circuit interruption is not interfered with at all by the dashpotting arrangement of the instant invention. A return spring 153 is provided to bring the dashpot plunger back to the extended position shown in FIG. 2 following a breaker opening operation.

Operation of the hydraulic circuit breaker arrangement shown in FIGS. 2 and 3 is as follows. When the system is in its at-rest position shown in FIG. 2, a volume of hydraulic liquid is stored in accumulator 50 under pressure maintained by the pump 100 via passage 90 through the ports 64 in the valve housing 60. Tube 102 is filled with liquid at substantially the pressure of the sump, which is typically one atmosphere. Under these conditions, tube 102 maintains the pressure on opposite sides of the piston 132 at substantially sump pressure. Any leakage past the closed valve member 62 will be vented to the sump through vent 82 and tube 102 to prevent the pressure in actuating space 80 from rising substantially above sump pressure. It is to be understood that the sump's liquid level is high enough to keep the components of the system, including tube 102, filled with liquid.

Upon receiving a signal indicating a command to open the circuit 16, coil 74 is energized by a suitable pulse of current which produces a rapidly rising repulsion force between the armature 70 and the coil 74 driving the rod 72 toward the right causing valve member 62 to be moved to the right against the closing force of spring 68. Movement of valve member 62 from its closed position to the right allows high pressure hydraulic liquid to immediately flow past valve seat 65, through large part 55, and build up a high pressure in the actuating space 80 above piston 132. This high pressure liquid also acts on the left hand face of movable valve member 62, rapidly providing a high force on the valve member that assists in forcing it to the right at high speed. When the valve member 62 nears its open position shown in FIG. 3 at the end of its rightward opening stroke, piston 76 thereon enters the closed end of the valve body providing a dashpotting effect that smoothly terminates such opening movement of the valve member.

As soon as the valve member 62 is opened to initiate a breaker opening operation, liquid pressure in the actuating space 80 rapidly rises. This causes rapid downward movement of piston 132 and rod 133 thereby separating movable contact 14 from fixed contacts 12 interrupting circuit 16. Since abutment 142 is not in engagement with piston 132 there is no hydraulic resistance to the downward movement of the hydraulic actuating mechanism during the initial phase of breaker opening. The only loss of hydraulic pressure is through the small orifice 82 in valve body 83 through the long restricted diameter tube 102, and since it takes a relatively long time for the column of hydraulic liquid present in the tube to accelerate in response to this pressure rise because of the inertia and friction effects of the long, small cross section tube 102 on the column of liquid, the loss of hydraulic pressure therethrough is negligible. Before acceleration of the liquid in tube 102 can increase to a level that produces any appreciable flow of liquid therethrough, piston 132 has already been moved downwardly through most of its opening stroke, preferably separating the contacts by about 75% of the nominal full gap therebetween. The amount of leakage through tube 102 is so small during this short period (2 or 3 milliseconds), that such leakage does not significantly detract from the development of pressure in the actuating space 80 following opening of valve member 62 and, correspondingly, does not introduce any significant delay in downward motion of the piston through the major portion of its opening stroke (as compared to that produced if no vent were present in the actuating space 80). By way of example and not limitation, a tube 102 suitable for this application will have a length of between 30 and 60 inches in a geometrical cross-sectional area of between 0.1 and 0.4 square inches.

As piston 132 (after having completed most of its opening stroke) decelerates in response to the above described dashpotting effect of the dashpot and spring arrangement, the hydraulic pressure in actuating space 80 rises; and this increased pressure produces leakage at an increased rate through venting orifice 82. This effective leakage through orifice 82 causes excess liquid in the accumulator at the end of the end of the downward operation of piston 132 to flow to the sump 103 through orifice 82 and tube 102. This allows pressure to drop in the cylinder actuating space 80 (after piston 132 has completed its downward opening stroke) which, in turn, allows movable valve member 62 to return to its closed position of FIG. 2. The movable valve member 62 in returning to its closed position blocks further communication between accumulator 50 and piston actuating space 80. This re-establishes free flow communication between actuating space 80 and the sump through orifice 82.

As described in the above cited U.S. Pat. No. 4,118,613, to reduce the time required for the desired pressure drop in the actuating space 80, the accumulator 50 has a limited capacity sufficient to produce only one complete opening operation without recharging of the accumulator. As a result of this capacity, leakage through orifice 82 for a relatively short period of time after piston 132 has completed its downward stroke is sufficient to cause the pressure in actuating space 80 to decay to sump pressure (essentially one atmosphere). After the circuit-breaker opening operation has been substantially completed, the sustained pressure within the actuating space has had an opportunity to accelerate the liquid column in the tube 102, greatly increasing the flow therethrough. This increased flow effects a rapid discharge of the remaining liquid in the accumulator 50 and thus causes a prompt decay in the pressure in the actuating space 80. When this pressure falls to a predetermined level, the valve-closing spring 68 drives the movable valve member 62 back into its closed position.

The length and the effective cross-sectional area of the long restricted tube 102 and the small restriction 104 in the line 90 are sized such that when the movable valve member 62 is open, there is no pressure build-up by the pump 100 in the actuating space 80 and there is no charging of accumulator 50. In effect, during this period, if the pump is operating, leakage through the tube 102 is occurring at a higher rate than liquid is being pumped through the restriction 104. The resultant pressure drop allows the valve member 62 to reset to its closed position, after which the accumulator is quickly charged by the pump.

When the pressure in accumulator 50 falls to a predetermined level, and the main valve is closed, a suitable pump 100 is activated through a conventional pressure-responsive electric switch (not shown) in the accumulator, and pump 100 responds by forcing high pressure liquid through duct 90 and space 92 (upstream of the main valve seat 65) into the accumulator. The rate at which pump 100 supplies liquid to the accumulator is controlled by an orifice 104 in duct 90. This orifice 104 is adequately small that it limits the rate at which pump 100 supplies liquid to accumulator 50 sufficiently that the pump cannot recharge the accumulator while main valve 56 is opened. During this interval, there is sufficient leakage through venting orifice 82 that accumulated recharging is effectively blocked. Only when the pressure in cylinder space 80 has decayed enough to allow main valve 56 to reclose can effective recharging of the accumulator by pump 100 begin. When movable main valve member 62 is in its closed position, venting orifice 82 is effectively isolated from the accumulator 50, and recharging can then be effected without interference from leakage through the venting orifice 82. If rapid recharging of the accumulator is required, a bypass may be provided around restriction 104, such as an unrestricted path controlled by a valve operated simultaneously with the main valve 56. In this way upon closing of main valve 56 accumulator 50 may be rapidly recharged to operating pressure.

When contact 14 reaches its fully opened position a suitable hold-open latch 20 acts to prevent circuit breaker reclosing. Reclosing is effected by a latch release solenoid 22, which is operated by completing an energizing circuit through its coil by closing a closing control switch 24. When release 20 has been moved by solenoid 22, closing spring 17 moves contact 14 into engagement with contacts 12 and raises the piston 132 back to its closed position shown in FIG. 2. The dashpot return spring 153 raises the plunger to its upper position shown in FIG. 2 out of contact with the bottom surface 131 of piston of 132. Upward motion of piston 132 produces only a very limited pressure buildup in space 80, because this space 80 is then freely vented through orifice 82 and tube 102 to atmospheric pressure sump. This limitation on pressure buildup in operating space 80 enables movable valve member 62 to remain seated while the piston moves upwardly through a breaker closing stroke. This is significant, since unseating of main valve member 62 would allow high pressure liquid from accumulator 50 to flow past main valve 56 into actuating space 80 and block continued circuit breaker closing. Closing spring 17 is selected to have adequate spring strength to return contact 14 to the closed position and overcome slight liquid pressure remaining in actuating space 80. Venting orifice 82 should be sufficiently large to limit pressure buildup in actuating space 80 sufficiently to prevent it from unseating main valve member 62 during closing. It is noted that a slight hydraulic closing bias on valve member 62 will result from dimension $D_1$ of movable main valve member 62 being slightly larger than dimension $D_2$ as shown in FIG. 3 which will assist in keeping valve 56 closed as pressure in actuating space 80 rises slightly during closing of the contacts.

If the circuit breaker is closed on a fault (i.e., when the line 16 has a fault thereon), it is important that the circuit breaker be capable of immediately reopening without delay to clear the fault. In the illustrated circuit breaker, such immediate reopening (or trip-free operation) is effected simply by opening main valve 56. This admits high pressure liquid from accumulator 50 to the actuating space 80 causing a rapid buildup of pressure in the actuating space as previously described in connection with a normal opening operation. Since closing spring 17 is selected to be able to overcome the approximately one atmospheric pressure in operating space 80 during a normal closing operation, the pressure applied to piston 132 is easily able to immediately effect the desired opening operation. To assure that the necessary liquid pressure will be available for such trip-free operation, suitable electrical interlock means (not shown) is provided to prevent initiation of a closing operation unless the accumulator 50 is substantially fully recharged. As noted above a high speed recharge capability may be provided to facilitate this rapid recharging.

It will be apparent from the above description that the instant invention provides for exceptionally fast, interference free operation of a circuit breaker upon an opening command. There is no hydraulic interference with the rapid opening of circuit breaker from the liquid usually present below the piston, as in FIG. 1, and the dashpotting required to smooth stopping of the rapidly moving circuit breaker actuating mechanism is provided by external dashpot 145, which is designed to limit shock to the actuating mechanism components. The mechanism described herein is simpler in construction than the prior art hydraulic mechanism, and by eliminating flow restriction from one portion of the actuating mechanism, the efficiency of the actuating mechanism and therefore its operating speed are significantly improved. Furthermore, external dashpots as employed in the instant invention are easily adjusted and maintained, since they are separate structures from the hydraulic actuating mechanism itself.

In the drawings the interrupting portion of the circuit breaker (i.e., contact structure 12, 14) has been shown schematically only. In a preferred form of the invention, this interrupting structure is constituted by one or more vacuum type circuit interrupters, such as disclosed for example in U.S. Pat. Nos. 3,462,572 Sofianek or 3,246,979 Lafferty et al. The above described invention may also be used with other types of circuit interrupters, such as oil interrupters or gas blast interrupters, including those of the puffer type, such as shown for example in U.S. Pat. Nos. 3,739,125 Noeske or 3,602,670 Teijeiro. Typically, non-vacuum interrupters have a much longer stroke than vacuum interrupters, and when the instant invention is to be used with such non-vacuum interrupters, effective leakage through vent 82 will occur during an opening operation ahead of the time the piston has reached the midpoint in its opening stroke. Effective leakage through orifice 82 is, however, delayed until piston 132 has moved through a substantial portion of its opening stroke, e.g., about 20%, so as to give sufficient opportunity for the piston to have been accelerated to an effective opening speed. The instant effective leakage begins can be advanced or delayed by appropriately sizing the length and diameter of tube 102, whether the operating system is to be used with a non-vacuum interrupter, such as a puffer type interrupter, or a vacuum type interrupter. In employing instant invention, if a longer stroke is required, the dashpot may be adjusted or modified so that the gap 152 between the abutment 142 and the piston surface 131 may be increased, so that any interference by the dashpot mechanism with the breaker opening can be minimized. This is another advantage of having external dashpot means, since the same dashpotting mechanism may be employed with a variety of circuit breaker types with necessary adjustments being made to the external apparatus.

The instant operating system when used with one or more vacuum interrupters does have the capability of achieving opening times of ½ cycle or less in a 60 cycles per second system. Such extra high speeds enable me to use my instant invention in a vacuum circuit breaker to achieve current limiting interrupting action, or first current zero interruption, or an exceptionally fast performance needed for typically high voltage DC circuit breakers of the commutated-capacitor type. The shorter stroke typical of vacuum type circuit interrupters makes the vacuum type interrupter more suitable for the usual high speed circuit breaker installation than puffer type interrupters. For example, a vacuum interrupter typically has a stroke of 1 inch or less, whereas the puffer circuit breaker typically has a stroke of 6–10 inches.

While I have shown and described a particular embodiment of my invention hereinabove, it will be obvious to those skilled in the art that various changes and modifications may be made without departing from our invention in its broader aspects; and I, therefore, intend herein to cover all such changes and modifications as fall within the true spirit and scope of my invention as described in the following claims.

What is claimed is:

1. An hydraulically-actuated operating system for an electric circuit breaker comprising:

a fluid motor comprising a cylinder, a piston rod and a movable piston mounted on said piston rod and adapted to move in an opening direction within said cylinder to open an electric circuit breaker and in a reverse direction within said cylinder during closing of the circuit breaker;

an accumulator for supplying pressurized liquid to a piston-actuating space within said cylinder;

a normally-closed valve located hydraulically between said accumulator and said actuating space and openable to establish communication between said accumulator and said actuating space so that pressurized liquid from said accumulator can flow through said valve to said actuating space to drive said piston in an opening direction, said valve comprising a movable valve member that is movable from a valve-closed to a valve-open position to open said valve and is returnable to said valve-closed position to close said valve;

a vent located hydraulically downstream of said valve with respect to said accumulator for affording communication between said actuating space and a low pressure region;

flow control means for restricting leakage through said vent to a rate that prevents said leakage from substantially detracting from the development of pressure within said actuating space during the period from initial opening of said valve to the time when said piston has moved through a substantial portion of its opening stroke, said flow control means acting following such period and while said valve is still open to allow effective leakage through said vent;

said accumulator having a limited capacity that results in the pressure within said actuating space decaying promptly to a low value as a result of effective leakage through a circuit-breaker opening stroke and while said movable valve member is in its valve-open position;

means for restoring said movable valve member to its closed position in response to said pressure decay in said actuating space; and dashpotting means comprising a shaft separate from said piston rod and disposed in axial alignment with said piston and opposite said actuating space, an abutment disposed at one end of said shaft and adapted to engage an end of said piston, and means for retarding motion of said shaft connected to the other end of said shaft, said abutment being axially spaced from said piston such that said piston contacts said dashpotting means abutment after travelling through said substantial portion of its opening stroke; said dashpotting means comprising the sole motion-retarding means for substantially retarding motion of said piston in said opening direction.

2. The operating system of claim 1 in which said flow control means comprises a long restricted tube hydraulically in series with said vent between said actuating space and said low pressure region for containing a column of liquid which must be accelerated to allow effective leakage through said vent.

3. The operating system of claim 2 wherein said dashpotting means comprises:

an enclosure having a generally cylindrical sleeve disposed therein; said sleeve having generally radially extending passages therethrough;

a plunger disposed within said enclosure generally concentrically within said sleeve; a shaft connected to said plunger at one end thereof and connected to an abutment at the other end thereof;

said shaft extending through an opening in the top wall of said enclosure and said abutment being disposed in spaced, axially aligned relationship with said piston of said fluid motor when the circuit breaker is closed and;

said enclosure contains a volume of hydraulic liquid; and said passages in said sleeve are sized such that hydraulic resistance to vertically downward movement increases as said plunger moves downward within said sleeve, thereby causing near the end of the downward movement of said piston a pressure rise in said actuating space such that leakage flow of liquid through said vent is accelerated.

4. The operating system of claim 1 in which said piston occupies a circuit-breaker closed position when the circuit breaker is closed and a circuit-breaker open position when the circuit breaker is open, and said operating system further comprises:

releasable latching means for holding said piston in said circuit-breaker open position after a circuit-breaker opening operation;

closing means operable upon release of said latching means for returning said piston to its circuit-breaker closed position; and wherein:

said vent is sufficiently unrestricted when said valve is closed to allow pressurized liquid ahead of said piston during its return motion to circuit-breaker closed position to be exhausted from said actuating space without developing sufficient pressure to actuate said valve member out of its valve-closed position.

5. The operating system of claim 2 in combination with:

pumping means operable to supply pressurized liquid to said accumulator for recharging said accumulator;

means for causing said pumping means to operate when the pressure in said accumulator is below a predetermined level, thereby supplying pressurized liquid to said accumulator; and a restriction disposed hydraulically between said pumping means and said accumulator that limits the rate at which the pumping means supplies liquid to said accumulator sufficiently so that accumulator-recharging is prevented while said valve member is in valve-open position and effective leakage is occurring through said vent.

6. The operating system of claim 5 wherein said dashpotting means comprises:

an enclosure having a generally cylindrical sleeve disposed therein; said sleeve having generally radially extending passages therethrough;

a plunger disposed within said enclosure generally concentrically within said sleeve; a shaft connected to said plunger at one end thereof and connected to an abutment at the other end thereof;

said shaft extending through an opening in the top wall of said enclosure and said abutment being disposed in spaced, axially aligned relationship with said piston of said fluid motor when said contacts are in the closed position; and said enclosure contains a volume of hydraulic liquid; and said passages in said sleeve are sized such that hydraulic resistance to vertically downward movement increases as said plunger moves downward within said sleeve, thereby causing near the end of the downward movement of said piston a pressure rise in said actuating space such that leakage flow of liquid through said vent is accelerated.

7. The operating system of claim 1 in which:

said valve consitutes a main valve and said movable valve member consitutes a movable main valve member;

said vent affords free communication between said actuating space and said low pressure region when said main valve is closed; and restoration of said movable main valve member to its closed position restores free communication through said vent between said actuating space and said low pressure region.

8. The operating system of claim 7 wherein said dashpotting means comprises:

an enclosure having a generally cylindrical sleeve disposed therein; said sleeve having generally radially extending passages therethrough;

a plunger disposed within said enclosure generally concentrically within said sleeve; a shaft connected to said plunger at one end thereof and connected to an abutment at the other end thereof;

said shaft extending through an opening in the top wall of said enclosure and said abutment being disposed in spaced, axially aligned relationship with said piston of said fluid motor when the circuit breaker is closed; and said enclosure contains a volume of hydraulic liquid; and said passages in said sleeve are sized such that hydraulic resistance to vertically downward movement increases as said plunger moves downward within said sleeve, thereby causing near the end of said opening stroke a pressure rise in said actuating space such that leakage flow of liquid through said vent is accelerated.

9. A method of operating a hydraulically actuated operating system for an electric circuit breaker comprising the steps of:

pressurizing a supply of a liquid breaker-operating medium disposed within a pressure accumulator;

supplying an unimpeded flow of said pressurized medium from said accumulator to a breaker-opening space of a fluid motor operably connected to one of the contacts of said circuit breaker through an unimpeded flow path hydraulically connecting said accumulator and said breaker-operating space by opening a valve disposed hydraulically between said accumulator and said breaker-opening space to move a piston rod of said fluid motor and a piston of said fluid motor and mounted on said piston rod in a breaker-opening direction; and following travel of said piston through a substantial portion of its opening stroke, contacting said piston to an abutment of a dashpotting means comprising a shaft separate from said piston rod and disposed in axial alignment with said piston and means for retarding motion of said shaft connected to said shaft, said abutment being thertofore separated from said piston; said dashpotting means comprising sole motion-retarding means for substantially retarding motion of said piston in said breaker-opening direction.

10. The method of claim 9 further comprising latching said breaker in said breaker-open position until a predetermined time after said breaker opening step.

11. The method of claim 10 further comprising biasing said breaker in said breaker-closed position and biasing said valve in a valve-closed position such that following said latching-open step;

releasing said breaker from said latched-open position and allowing said breaker to return to said breaker-closed position.

12. The method of claim 11 further comprising the step of after said valve is returned to said breaker-closed position recharging said accumulator by admitting a flow of pressurized liquid into said accumulator through the body of said valve.

* * * * *